US009394146B2

(12) United States Patent
Schroder

(10) Patent No.: US 9,394,146 B2
(45) Date of Patent: Jul. 19, 2016

(54) ASSEMBLING AN AUXILIARY LIFTING UNIT ON A MOBILE CRANE

(75) Inventor: Dierk Schroder, Grossenkneten (DE)

(73) Assignee: Manitowoc Crane Group France SAS, Ecully (FR)

( * ) Notice: Subject to any disclaimer, the term of this patent is extended or adjusted under 35 U.S.C. 154(b) by 123 days.

(21) Appl. No.: 13/216,083

(22) Filed: Aug. 23, 2011

(65) Prior Publication Data

US 2012/0118846 A1 May 17, 2012

(30) Foreign Application Priority Data

Aug. 24, 2010 (EP) ..... 10173822

(51) Int. Cl.
*B66C 23/62* (2006.01)

(52) U.S. Cl.
CPC ..... *B66C 23/62* (2013.01); *Y10T 29/49826* (2015.01)

(58) Field of Classification Search
CPC ..... B66C 23/36; B66C 23/62; B66C 23/86
USPC ..... 254/323; 212/167, 179, 180
See application file for complete search history.

(56) References Cited

U.S. PATENT DOCUMENTS

| | | | | | |
|---|---|---|---|---|---|
| RE14,858 | E | * | 5/1920 | Miller | 254/267 |
| 1,444,737 | A | * | 2/1923 | Fraley | 192/16 |
| 1,474,054 | A | * | 11/1923 | Bolger et al. | 254/323 |
| 4,081,081 | A | * | 3/1978 | Morrow et al. | 212/178 |
| 4,483,448 | A | * | 11/1984 | Wittman et al. | 212/304 |
| 4,700,851 | A | * | 10/1987 | Reeve et al. | 212/181 |
| 5,443,169 | A | * | 8/1995 | Pagel et al. | 212/298 |
| 5,484,069 | A | * | 1/1996 | Lanning | 212/270 |
| 6,062,405 | A | * | 5/2000 | Pech et al. | 212/298 |
| 6,131,751 | A | * | 10/2000 | Pech et al. | 212/178 |
| 6,226,955 | B1 | * | 5/2001 | Lorrigan | 52/745.05 |
| 6,619,620 | B1 | * | 9/2003 | Carter | 254/10 C |
| 7,007,764 | B2 | * | 3/2006 | Smith et al. | 180/9.1 |
| 7,086,547 | B2 | * | 8/2006 | Hanamoto | 212/175 |
| 7,896,316 | B2 | * | 3/2011 | Willim | 254/323 |
| 8,302,789 | B2 | * | 11/2012 | Hanahara et al. | 212/179 |
| 8,397,924 | B2 | * | 3/2013 | Wanek | 212/175 |
| 2003/0146181 | A1 | * | 8/2003 | Taylor et al. | 212/299 |
| 2003/0230744 | A1 | * | 12/2003 | Rawlinson | 254/323 |
| 2008/0093321 | A1 | * | 4/2008 | Miyazaki | 212/177 |
| 2008/0116161 | A1 | * | 5/2008 | Kurotsu et al. | 212/262 |
| 2008/0302749 | A1 | * | 12/2008 | Sawai et al. | 212/233 |
| 2010/0072156 | A1 | * | 3/2010 | Mentink et al. | 212/196 |

FOREIGN PATENT DOCUMENTS

| | | | |
|---|---|---|---|
| DE | 202 03 662 | U1 | 7/2003 |
| DE | 199 56 312 | A1 | 5/2011 |
| JP | 2001 220088 | A | 8/2001 |

* cited by examiner

*Primary Examiner* — Emmanuel M Marcelo
*Assistant Examiner* — Michael Gallion
(74) *Attorney, Agent, or Firm* — Brinks Gilson & Lione; John C. Bacoch

(57) ABSTRACT

The invention relates to an assembly system for a mobile crane auxiliary lifting unit comprising auxiliary lifting unit assembly fastenings which are coupled to the auxiliary lifting unit and serve to fasten the auxiliary lifting unit to the crane, and comprising an assembly unit which can move the auxiliary lifting unit assembly fastenings into an assembly position. It also relates to an assembly installation for a mobile crane auxiliary lifting unit, comprising such an assembly system and comprising a sub-structure. A footing support for a mobile crane auxiliary lifting unit and a method for assembling a mobile crane auxiliary lifting unit are also disclosed.

18 Claims, 13 Drawing Sheets

10
12
14
16
18
20
22
24
26
28
30
32
34
36
38
40

ASSEMBLING AN AUXILIARY LIFTING UNIT ON A MOBILE CRANE

FIELD

The present application relates to the field of auxiliary lifting units for a mobile crane, and more particularly to systems and methods for assembling an auxiliary lifting unit on a mobile crane.

BACKGROUND

The present invention generally relates to a method and structure for adding an auxiliary lifting unit to a mobile crane. In particular, it deals with an assembly system for a mobile crane auxiliary lifting unit, and with a method for assembling a mobile crane auxiliary lifting unit; in addition, a footing support for a mobile crane auxiliary lifting unit is disclosed.

The use of auxiliary lifting units for augmenting the main lifting units is known in the mobile crane industry. Mostly, auxiliary lifting units are provided as separate units that can be added to a crane and employed as needed. To secure them to a crane, such auxiliary lifting units have assembly fastenings, which mostly are disposed on their frame parts and serve for fastening the auxiliary lifting unit to the crane.

Heretofore, the auxiliary lifting units, which have to be moved with power-assisted means due to their weight and their dimensions, are mostly moved and assembled, i.e. lifted and then fastened to a rotary table receptacle, with the aid of a traditional counterweight lifting system found on the crane.

Disadvantageously, this approach entails a high demand of work and attention by the operating personnel in order to accomplish the exact assembly of the auxiliary lifting unit by means of a lifting unit that is actually designed to move counterweights.

Against this background, it is the object of the present invention to provide an assembly system, as well as a method for assembling a mobile crane auxiliary lifting unit, which results in the connection of such an auxiliary lifting unit to a crane in an improved manner. In particular, the assembly can be performed with a reasonable amount of work, time, and attention.

SUMMARY

An embodiment of an assembly system for an auxiliary lifting unit of a mobile crane. The assembly system includes an auxiliary lifting unit frame and auxiliary lifting unit assembly fastenings coupled to the auxiliary lifting unit. The auxiliary lifting unit assembly fastenings are adapted to fasten the auxiliary lifting unit to the mobile crane. The assembly system also includes an assembly unit coupled to the auxiliary lifting unit assembly fastenings and adapted to move the assembly fastenings into an assembly position.

In some embodiments the auxiliary lifting unit assembly fastenings are coupled to the auxiliary lifting unit frame and the assembly unit is adapted to lift the auxiliary lifting unit frame and auxiliary lifting unit fastenings together. In other embodiments the auxiliary lifting unit assembly fastenings are coupled to the assembly unit and the assembly unit is adapted to lift auxiliary lifting unit fastenings relative to the auxiliary lifting unit frame.

The assembly position may be a fastening position on an upper structure of the crane, in which engagement between the auxiliary lifting unit assembly fastenings and mating fastenings on the crane upper structure occurs. The assembly unit may be adapted to move the assembly fastenings into the assembly position in a direction selected from the group consisting of upwards, downwards, obliquely upwards, obliquely downwards, and laterally.

The assembly unit may include a drive unit selected from the group consisting of an electrical drive unit, hydraulic drive unit, pneumatic drive unit, and a combination drive unit. The assembly unit may include a hydraulic lifting cylinder device coupled to the auxiliary lifting unit frame and may be adapted to move the auxiliary lifting unit frame away from a sub-structure element.

In some embodiments, the sub-structure element is a support base connected to the frame by the assembly unit from which the auxiliary lifting unit frame can be lifted away into the assembly position by means of the assembly unit. The assembly unit may be connected to the support base in a compression-proof and tension-proof manner. The sub-structure element may be adapted for supporting the auxiliary lifting unit. The sub-structure may include a topmost mounted counterweight element. The sub-structure may include a mounting rack placed on a counterweight support.

In some embodiments, a plurality of feet is disposed on the support base facing away from the auxiliary lifting unit frame. The plurality of feet may be footing supports adjustable in position. In some embodiments mating footing supports are disposed on the sub-structure and are complementary to the plurality of feet.

In another embodiment a footing support for a mobile crane auxiliary lifting unit is disclosed. The footing support includes at least one foot having a downwardly protruding footing support element adapted to have a restricted mobility and adjustability in at least one direction with respect to the auxiliary lifting unit. The footing support element may be resiliently deformable transversely to its attachment. The footing support element may have a slotted sleeve adapted to rotate 360 degrees and the footing support is seated on a bolt and is attached displaceably transverse to a longitudinal axis of the bolt my means of the slotted sleeve. The footing support element may be attached to the auxiliary lifting unit with a lockable support adjustable along a longitudinal axis of the footing support element.

The footing support may be coupled to an auxiliary lifting unit assembly system including an auxiliary lifting unit frame, auxiliary lifting unit assembly fastenings coupled to the auxiliary lifting unit frame, the auxiliary lifting unit assembly fastenings adapted to fasten the auxiliary lifting unit to the mobile crane, and an assembly unit coupled to the auxiliary lifting unit assembly fastenings and adapted to move the auxiliary lifting unit assembly fastenings into an assembly position.

In another embodiment a method for assembling a mobile crane auxiliary lifting unit with auxiliary lifting unit assembly fastenings, which are assigned to the frame of the auxiliary lifting unit and serve for fastening the auxiliary lifting unit to the crane is disclosed. The method includes moving the auxiliary lifting unit into an assembly position, wherein the movement is effected by an assembly unit attached to the auxiliary lifting unit, which moves the auxiliary lifting unit frame into the assembly position.

The method may be performed by an assembly system including an auxiliary lifting unit frame, auxiliary lifting unit assembly fastenings coupled to the auxiliary lifting unit frame, the auxiliary lifting unit assembly fastenings adapted to fasten the auxiliary lifting unit to the mobile crane, and an assembly unit coupled to the auxiliary lifting unit assembly fastenings and adapted to move the auxiliary lifting unit assembly fastenings into an assembly position.

In another embodiment another method for assembling a mobile crane auxiliary lifting unit is disclosed. The mobile crane auxiliary unit has an assembly system with a frame, auxiliary lifting unit fastenings coupled to the frame, an assembly unit coupled to the frame, and a sub-structure coupled to the assembly unit. The method includes causing the assembly unit to move the mobile crane auxiliary lifting unit relative to the sub-structure from a first location to a second location, and positioning a crane upper structure adjacent the auxiliary lifting unit fastenings.

BRIEF DESCRIPTION OF THE DRAWINGS

To further clarify the above and other advantages and features of the one or more present inventions, reference to specific embodiments thereof are illustrated in the appended drawings. The drawings depict only typical embodiments and are therefore not to be considered limiting. One or more embodiments will be described and explained with additional specificity and detail through the use of the accompanying drawings in which:

FIG. 9 is a perspective view of the assembly system of FIG. 6 with the assembly unit actuated, lifting the frame of the auxiliary lifting unit from the base.

FIG. 11 is a perspective view of the assembly system of FIG. 6 with a piston engaging the counterweight, thereby attaching the counterweight to the upper structure.

Figures 1, 2, 3, 4:
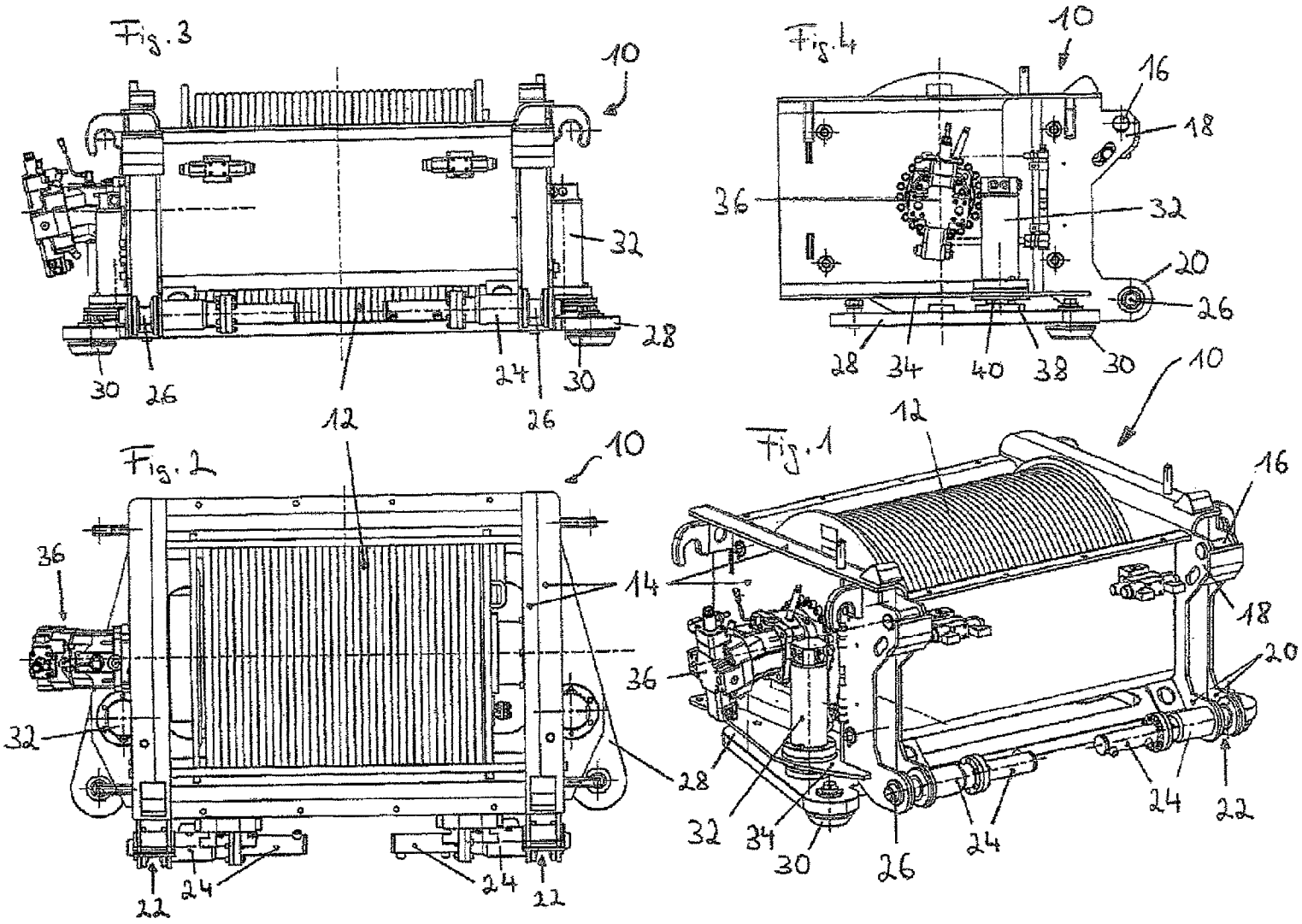
FIG. 1 is a perspective view of an auxiliary lifting unit designed according to the invention.
FIG. 2 is a top view of the auxiliary lifting unit of FIG. 1.
FIG. 3 is a lateral view of the auxiliary lifting unit of FIG. 1.
FIG. 4 is a front view of the auxiliary lifting unit of FIG. 1.

The drawings are not necessarily to scale.

DETAILED DESCRIPTION

Embodiments of the invention include methods for assembling an auxiliary lifting unit and assembly systems using an auxiliary lifting unit with a frame. Auxiliary lifting unit assembly fastenings are coupled to the auxiliary lifting unit and serve to fasten the auxiliary unit to the crane. The assembly system further includes as assembly unit, which is configured to move the auxiliary lifting unit fastenings into an assembly position.

In some embodiments, the auxiliary lifting unit assembly fastenings are coupled to the frame of the auxiliary lifting unit. In such embodiments, the assembly unit moves the frame coupled to the auxiliary lifting unit assembly fastenings, thereby moving the auxiliary lifting unit assembly fastenings. In other embodiments, the auxiliary lifting unit assembly fastenings are coupled to the assembly unit and the assembly unit moves the auxiliary lifting unit assembly fastenings directly. In either case, the assembly unit moves the auxiliary lifting unit assembly fastenings and the auxiliary lifting unit assembly fastenings are considered to be coupled to the frame of the auxiliary lifting unit. In other words, the assembly system includes its own mounting equipment, which is capable of moving the required parts of the auxiliary lifting unit, including the auxiliary lifting unit itself, into an assembly position that allows or enables performing the operation of connecting the auxiliary lifting unit to the crane. In this sense, the assembly unit could also be considered as a moving or adjusting means for the auxiliary lifting unit.

The assembly unit supports the assembly operation in such a manner that it can be performed in a considerably less extensive and labor-intensive manner and in some embodiments it may even be in an automatic or semi-automatic manner. The assembly unit discourages the misuse of a counterweight lifting system to lift the auxiliary lifting unit. The auxiliary lifting unit assembly operation can be performed fast and in a very safe manner, in particular because the automatic or semi-automatic assembly unit will reproducibly perform the same, correct actions.

The assembly position can be a fastening position on the crane upper structure, in which engagement between the auxiliary lifting unit assembly fastenings and mating fastenings occurs. The mating fastenings are disposed on the crane upper structure, and in some embodiments, are on the main lifting unit. Of course, the assembly position can be at any appropriate location on the mobile crane, where it makes sense to fasten the auxiliary lifting unit according to the crane configuration. The assembly unit can operate or act in very different manner as well as direction. For example, depending on the embodiment, the assembly unit can move, displace, or transfer the auxiliary lifting unit assembly fastenings upwards, downwards, obliquely upwards or downwards or laterally into the assembly position. Further, various driving and operating types are conceivable, namely electrical, hydraulic, pneumatic, or a combination thereof. Of course, a mechanical drive plays a role in each of the mentioned driving types or can also be used separately or alone. In some embodiments, manually operated mechanical drives such as crank drives or geared transmissions are also employable.

In one embodiment, the assembly unit includes a hydraulic lifting cylinder device configured to lift the auxiliary lifting unit frame away or off of a sub-structure element. Such a sub-structure element can be a part of the auxiliary lifting unit. Very generally, in some embodiments, the auxiliary lifting unit and its assembly unit advantageously constitute a single unit.

In one configuration of the assembly system, the sub-structure element is a support base or base plate. In some embodiments the base plate is connected to the frame via the assembly unit or the lifting cylinder device, from which the frame can be lifted off into the assembly position by means of the assembly unit or the lifting cylinder device. In this embodiment, the sub-structure element can be the base plate that rests on the corresponding crane part and is configured to remain in position while the assembly unit lifts the rest of the auxiliary lifting unit away from this sub-structure construction into the assembly position.

In some embodiments the assembly unit or the lifting cylinder device is connected to the support base or base plate in compression-proof or in a tension-proof and compression-proof manner. In the latter case (tension-proof and compression-proof), the frame cannot only be forced away from the sub-structure construction by the lifting cylinder device, but the sub-structure can then also be pulled towards the frame by the lifting cylinder device after the assembly operation, such that the auxiliary lifting unit becomes free from its mounting place.

In some embodiments, several feet are disposed on the bottom or on the side of the support base or base plate facing away from the frame. Preferably, the feet are adjustable in position. Such feet may also be disposed immediately on the bottom part of the assembly unit, e.g. in the case where support base or base plate is not present below the assembly unit.

Embodiments of the invention include an assembly. The assembly includes the assembly system, as it has been previously described, and further includes a sub-structure appropriate or adapted for fitting the auxiliary lifting unit or its support base or base plate. Such a sub-structure can be the topmost mounted counterweight element and/or a mounting rack placed on the counterweight support or a counterweight element.

In an alternative embodiment of the assembly installation, mating footing supports are provided on the sub-structure. In particular, the counterweight support or the mounting rack includes mating foot supports, complementary to the feet of the support base or base plate.

Feet or a footing support for a mobile crane auxiliary lifting unit were previously mentioned above. Such a footing support is herein individually disclosed, thus as a device individually establishing an inventive unit. However, the footing support can also constitute a part of an assembly system or of an assembly installation, as they are described in detail below. In any case, the footing support has a footing support element protruding downwards, which has restricted mobility and/or adjustability in at least one direction with respect to the auxiliary lifting unit.

Heretofore, such footing supports were mostly implemented as pointed pin constructions with steel pins, which could be inserted into receiving holes in the sub-structure. However, such a rigid support is highly inflexible and renders the assembly operation slow and complicated, since exact insertion becomes required. However, if a restricted mobility in at least one direction with respect to the auxiliary lifting unit is present, increased tolerances are possible for this direction in both the manufacture and in the placement of the auxiliary lifting unit on its sub-structure. A movable assembly includes in this sense both adjustability in one direction and mobility, which can be achieved by constructional measures, but also by material selection. For example, the footing support element can be designed to be resiliently deformable, in particular perpendicularly to its longitudinal axis or transversely to its attachment such that mobility in two axes perpendicular to the longitudinal axis exists.

Another possibility is to equip the footing support element on the auxiliary lifting unit, on the support base, or on the base plate thereof with a lockable support that is adjustable along the longitudinal axis of the footing element or in the direction of its attachment. In some embodiments the locking support is a lockable screw-thread connection. Such a connection makes possible a simple height adjustment. Mobility or adjustability of the footing support element can reduce the manufacturing costs, because the tolerances for the components can be increased. In addition, the machining work decreases. Also for adjacent components, large manufacturing tolerances can be accommodated, e.g. in using cast plate receiving holes and in particular also in the assembly operation in case a cast plate (sub-structure) is not centrically placed. Because the receiving points can be designed larger and thus are better visible to the crane driver, the assembly operation can be performed faster, and with sufficient installation space, receiving auxiliary structures can be partially or totally omitted, such as the above already mentioned pointed pin constructions.

Embodiment of the invention are further directed to methods for assembling a mobile crane auxiliary lifting unit with auxiliary lifting unit assembly fastenings, which are assigned to the frame of the auxiliary lifting unit and serve for fastening the auxiliary lifting unit to the crane, the auxiliary lifting unit or its auxiliary lifting unit frame and/or the auxiliary lifting unit assembly fastenings are moved, displaced or transferred into an assembly position. Therein, the movement, the displacement, or the transfer is effected by an assembly unit attached to the auxiliary lifting unit, which moves the auxiliary lifting unit frame and/or the auxiliary lifting unit assembly fastenings into the assembly position. Of course, the method according to the invention again has those advantages and optional features, which have already been described above based on the assembly system and the assembly installation, respectively. In addition, in a method according to the invention, in various embodiments, an assembly system, an assembly installation, or a footing support can be used or employed in assembly, as they have been described above or are described below in detail.

An embodiment of a mobile crane auxiliary lifting unit equipped with an assembly unit according to embodiments of the invention is shown in FIGS. 1 to 4. Therein, FIG. 1 shows an oblique, perspective view from top left, FIG. 2 shows a top view, FIG. 3 shows a side view and FIG. 4 shows a front view.

The auxiliary lifting unit overall bears the reference number 10. At this point it is to be noted that reference numbers, which are continuously used in the figures, also denote identical or at least functionally equivalent parts.

The auxiliary lifting unit 10 has a steel frame 14, in which a rope winch 12 is rotatably supported. On a front side, which serves as a view side in FIG. 4, the connection piece 36 for the winch 12 protrudes from the frame 14.

The auxiliary lifting unit 10 additionally includes three modules, namely the module of the assembly fastenings, the module of the assembly unit, and the footing support module. The auxiliary lifting unit 10 is fastened to the crane upper structure, e.g. to the main lifting unit, by the auxiliary lifting unit assembly fastenings, while the assembly unit can move into an assembly position in the frame by the auxiliary lifting unit assembly fastenings. At this point it is to be noted that the auxiliary lifting unit 10 itself, only its frame 14 or else only the auxiliary lifting unit assembly fastenings very generally can be moved with the assembly unit 10 such that the assembly position is achieved. However, a combination of these components can also be moved, as it is the case in the present example.

The auxiliary lifting unit assembly fastenings, by which the auxiliary lifting unit 10 of FIGS. 1 to 4 is secured in its working position, are located on the side of the lifting unit 10, which can be seen in FIGS. 1 and 3. They are identically attached to the edges on both sides and mirror-inverted and have a projection 18 at the top, which retains a bolt 16 from two sides. At the bottom, a double projection 20 is in turn formed, which forms an interspace 22, into which a bolt 26 can extend from the piston-cylinder unit 24. As already mentioned, the bolts 16 and 26 serve for fastening the auxiliary lifting unit frame 10 to the crane upper structure or to the main lifting unit, as is explained below in more detail.

The second module of the lifting unit 10 is the assembly unit, which is capable of lifting the auxiliary lifting unit 10 and of moving it into an assembly position, in which the bolts 16 and 26 form a mounting engagement. The piston-cylinder unit disposed at each front side on the frame 10 is responsible for the lifting movement, wherein the cylinder has obtained the reference number 32 and the piston has obtained the reference number 40. While the cylinder is attached to the frame 10 via the lateral plate 34 (FIG. 1), the piston 40 has an attachment to the base plate 28 via its end piece 38, which is well visible in FIGS. 1 and 4. By extending the piston 40 from the cylinder 32, the frame 10 moves upward away from the plate 28, retracting again causes the approach between the plate 28 and frame 10. Thereby, of course, the altitude of the bolts 26 and 16 on the assembly fastening also varies such that mounting engagement at these locations can be effected. This mechanical system is explained in more detail below.

The third module of the auxiliary lifting unit 10, which becomes apparent in FIGS. 1 to 4, is the footing support, which is realized here with feet 30 apparent in FIGS. 1, 3 and 4. The footing support and the feet 30 have a footing support element tapering downwards and made of resilient material, which can be particularly simply inserted into a mating support and therein allows or accommodates large tolerances and positioning inaccuracies. The feet 30 are disposed at the bottom at the (four) corners of the base plate 28; they are explicitly illustrated on the front side. Here, it is also to be noted that basically only at least one of the feet 30 has to be configured resilient or movable or adjustable for tolerance compensation, wherein, of course, there is also the possibility of configuring two, three or four of the feet, i.e. very generally individual, plural or all feet according to the definition of the footing support according to the invention.

Based on FIGS. 5 to 11, a mounting operation/assembly operation for an auxiliary lifting unit 10 using the present embodiments is exemplarily described. In this embodiment, the auxiliary lifting unit 10 is placed on the counterweight package 44 apparent in FIG. 5 in preparation for the assembly operation. The counterweight package 44 rests on the undercarriage 42 of a mobile crane, and the topmost counterweight with the foot receptacles 48 formed as round, concave recesses is used as a sub-structure for the assembly operation.

Figure 6:
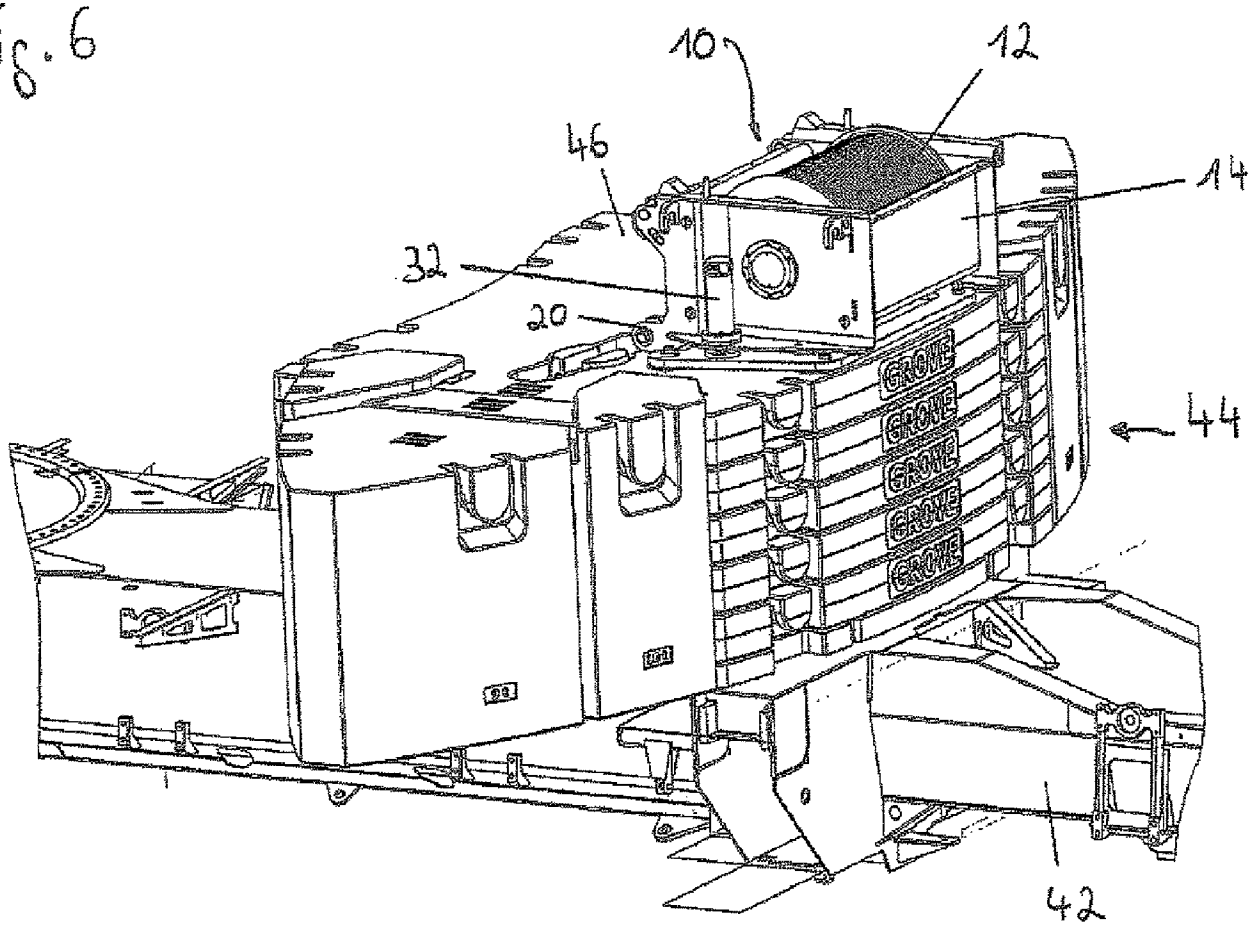
FIG. 6 is a perspective view of the crane undercarriage counterweights of FIG. 5 with the auxiliary lifting unit of FIG. 1 placed on the topmost counterweight, providing an assembly system.
Figure 7:
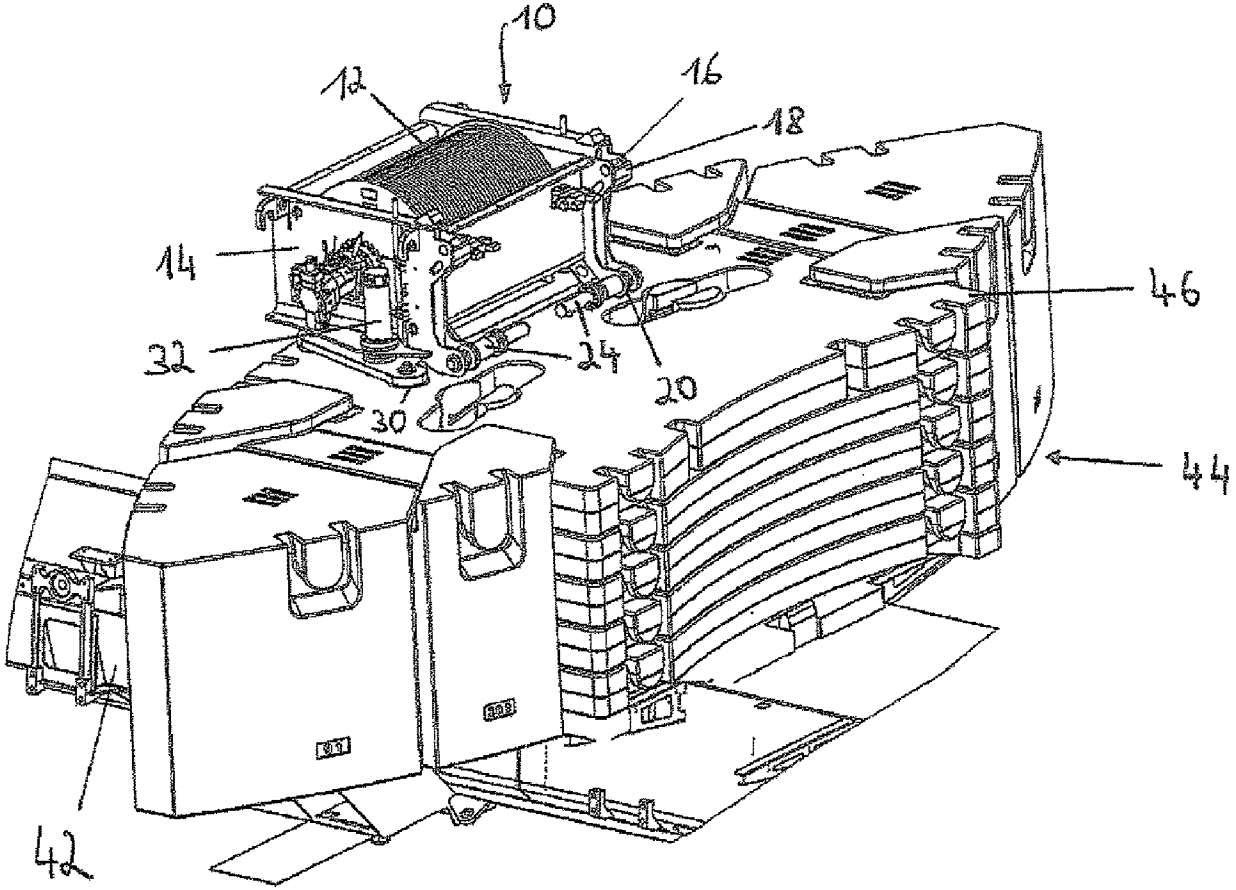
FIG. 7 is a perspective view of the assembly system of FIG. 6 from the opposing side.

FIG. 6 shows how an auxiliary lifting unit 10 has been placed on the topmost counterweight plate 46 in preparation for the assembly operation such that the feet almost no longer visible here, have been inserted into the foot receptacles 48. The same state is represented in an oblique view from the opposing side in FIG. 7, where the previously mentioned foot 30 is also indicated with a reference number in its footing support. The direction "front" relative to the crane undercarriage 42 is obliquely to top left in FIG. 6 and obliquely to bottom right in FIG. 7, such that one can say that the auxiliary lifting unit 10 is placed on the topmost counterweight element 46 with its auxiliary lifting unit assembly fastenings 16, 18, 20, 24 on the crane oriented to the front.

Figure 5:
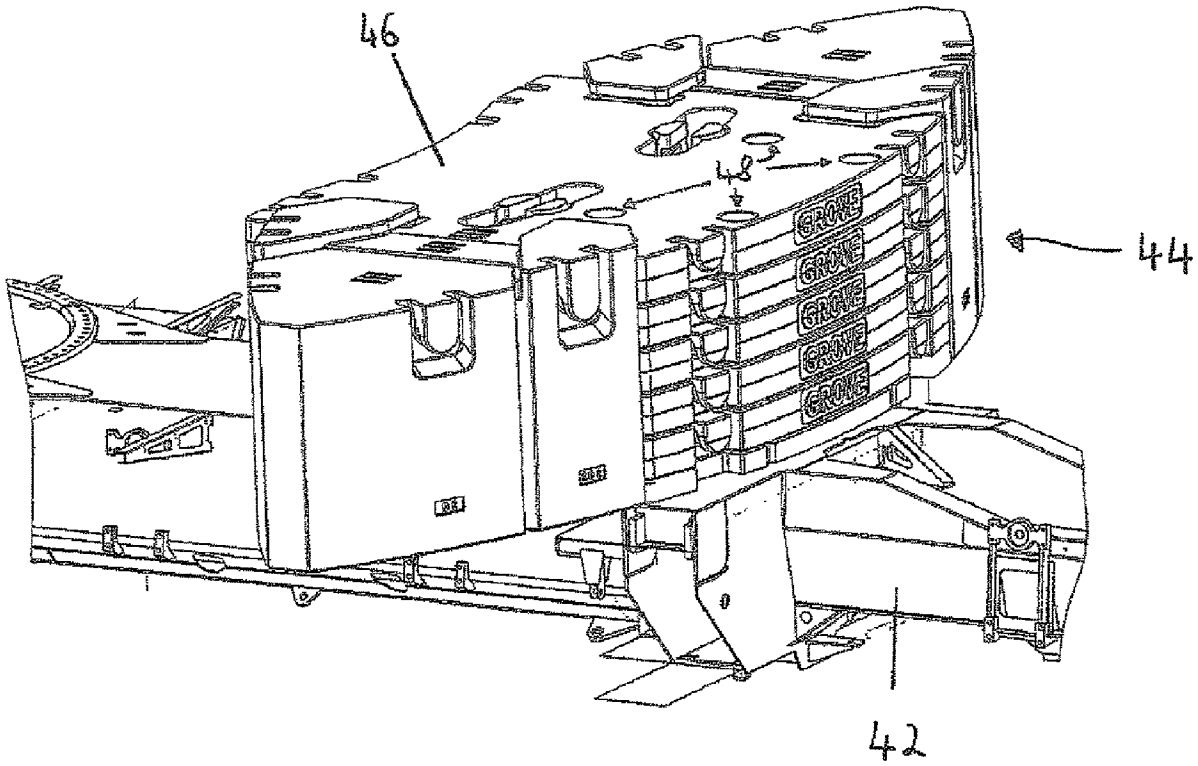
FIG. 5 is a perspective view of a crane under carriage and counterweight which can be used as a sub-structure for supporting the auxiliary lifting unit of FIG. 1 during assembly of the auxiliary lifting unit to a crane upper structure.
Figure 8:
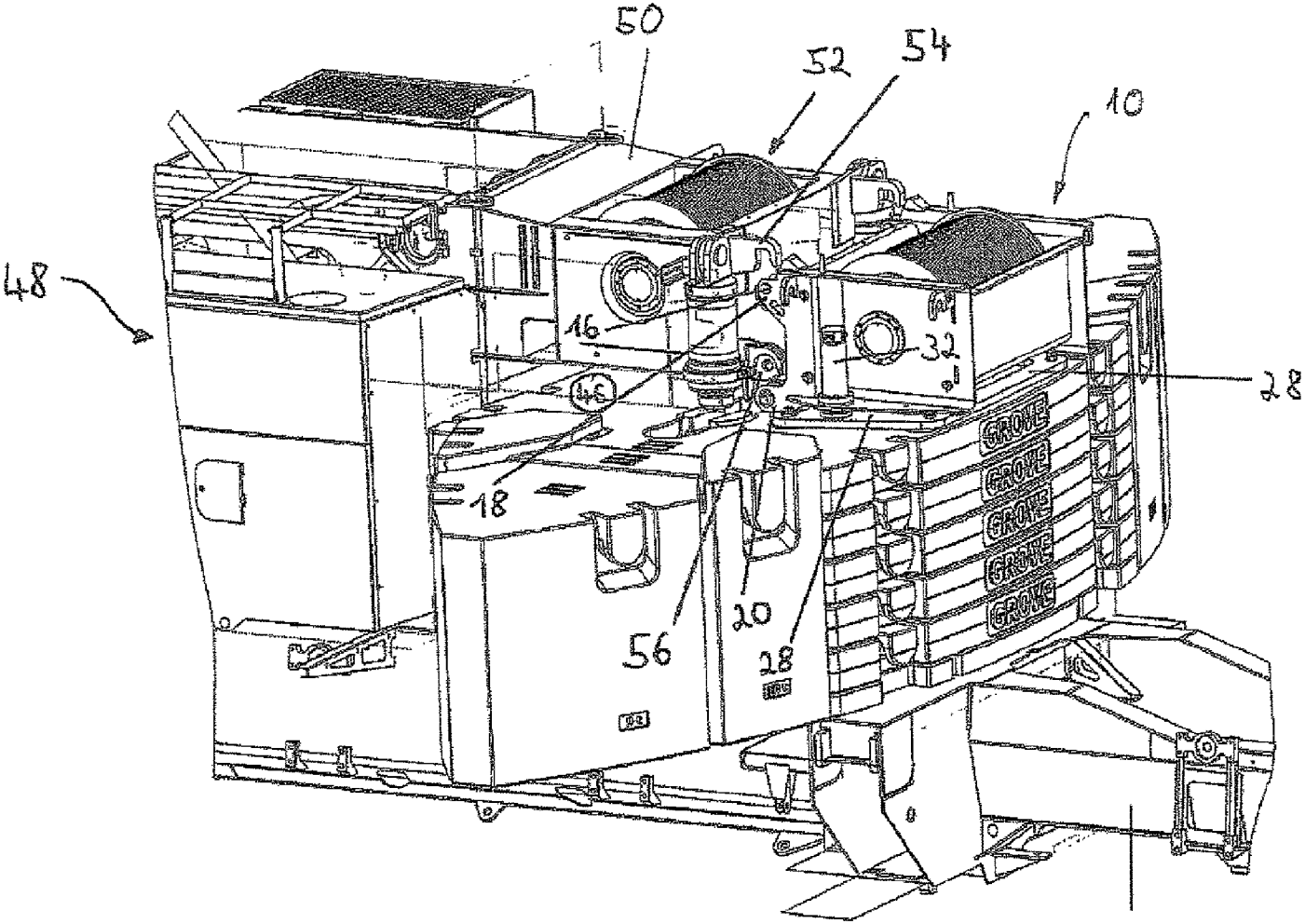
FIG. 8 is a perspective view of the assembly system of FIG. 6 with the crane upper structure turned rearward, placing the main lifting unit proximate the auxiliary lifting unit.
Figure 5:
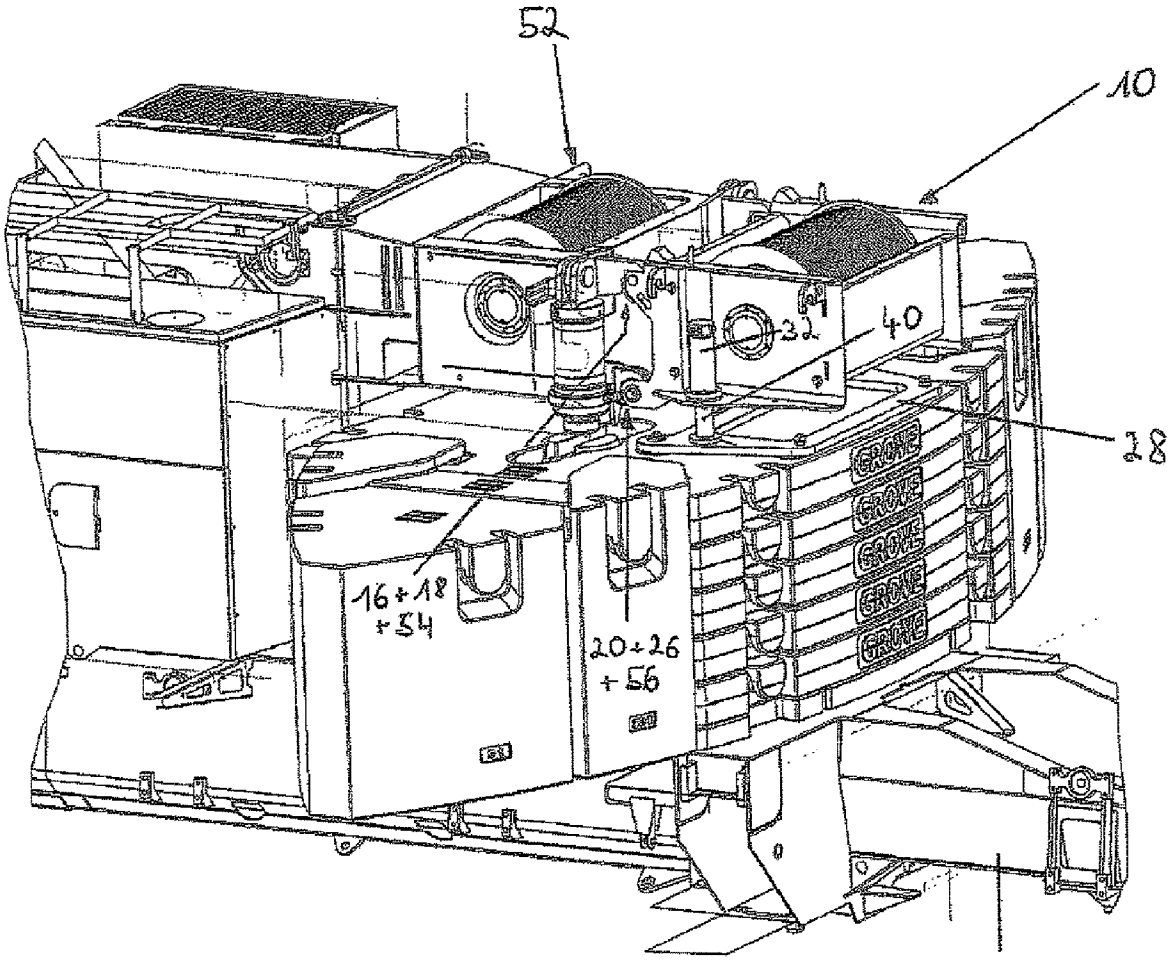

The assembly operation is further apparent from FIG. 8, wherein the view direction again corresponds to that of FIGS. 5 and 6. In FIG. 8, the auxiliary lifting unit 10 still stands on the topmost counterweight element 46, as it has been shown in FIGS. 6 and 7. However, the crane upper structure 48 with the lifting unit retainer 50, to which the main lifting unit 52 is attached, has turned rearward such that it is placed above the crane undercarriage 42 and oriented straight to the front and rear. In this position, the main lifting unit 52 comes into a position, in which the mating fastenings 54 and 56 attached the auxiliary lifting unit come to lie just freely above the auxiliary lifting unit assembly fastenings 16, 18 and 20. The mating fastenings 54 and 56 include upper hook elements 54 attached on both sides and catching and centering lugs 56 attached on both sides at the bottom. In the configuration of FIG. 8, the piston-cylinder unit with the cylinder 32, thus the assembly unit, is still completely retracted such that the frame 10 sits closely above the plate 28.

Now, the assembly unit is actuated in order to perform the attachment of the auxiliary lifting unit 10 to the main lifting unit 52, and the state after this step is shown in FIG. 9. It can be seen that the piston 40 of the assembly unit has been extended from the cylinder 32 and has lifted the frame of the auxiliary lifting unit 10 from the base plate 28 towards the top. In this operation, the bolt 16 has entered the hook 54 at the upper rear side of the main lifting unit 52 (between its supports 18) on the one hand, the projection 20 has been captured on both sides at the lower side in the capturing and centering lug 56 with first not released bolt 26 on the other hand. In this state, the bolt 26 can then be introduced into the interspace 22 with the aid of the piston/cylinder unit 24 (see e.g. FIG. 1), and a centered, fixed bolt connection has been achieved between the main lifting unit 52 and the auxiliary lifting unit 10 at the bottom. The fastenings 16, 18 and 54 provide for tipping stability at the top on both sides.

Figure 10:
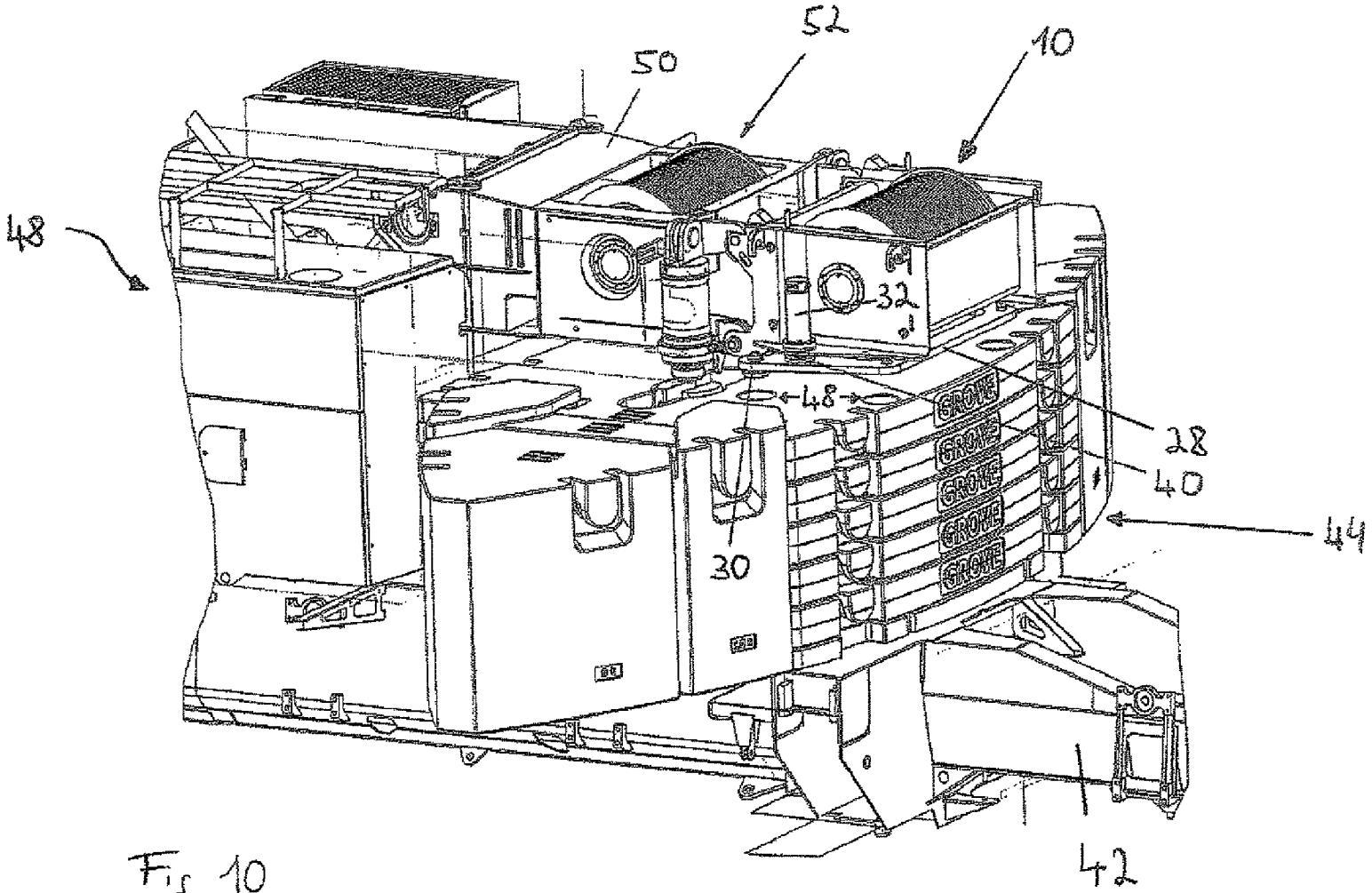
FIG. 10 is a perspective view of the assembly system of FIG. 6 with the assembly unit retracted pulling the base toward the auxiliary lifting unit.
Figure 8A:
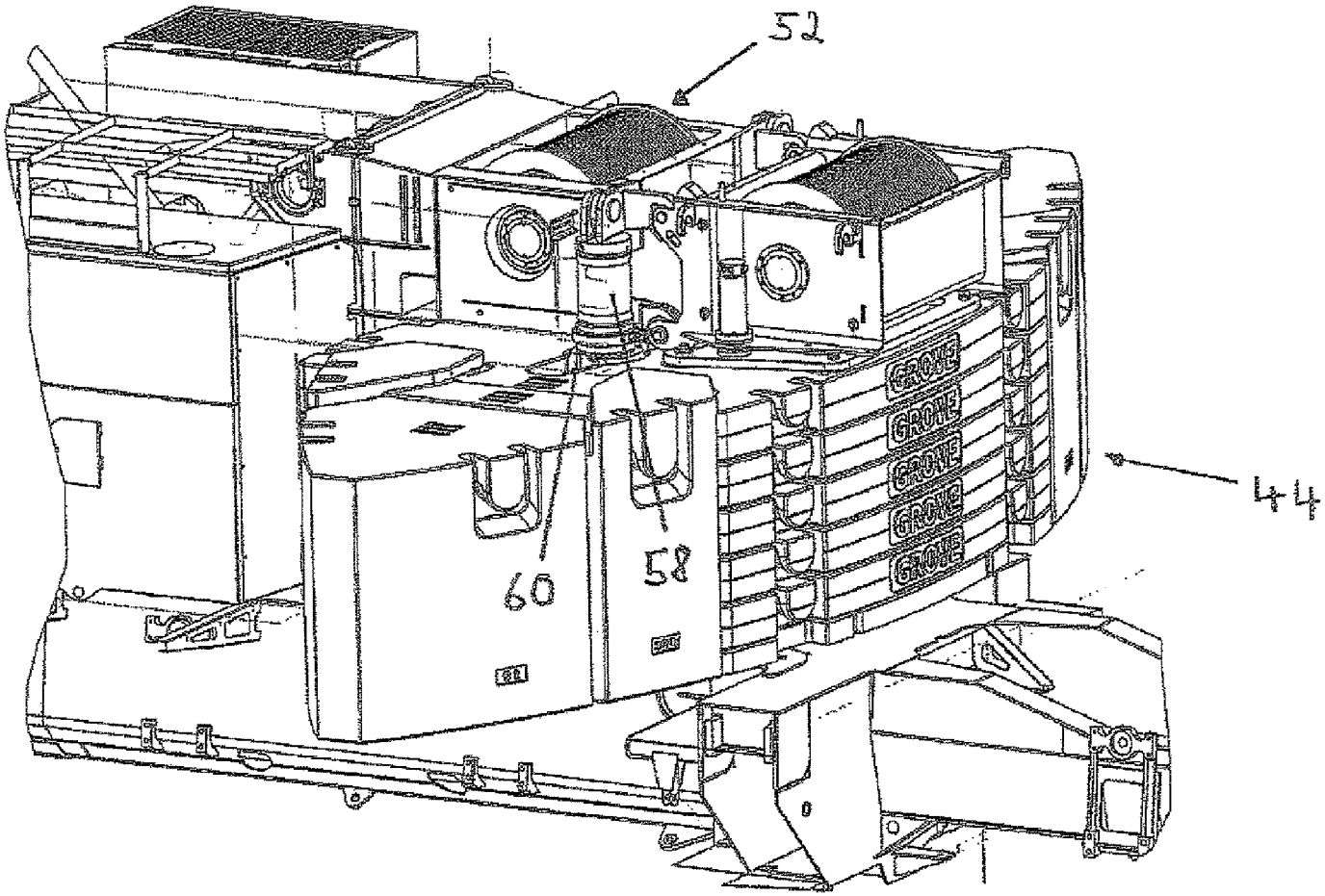

In a further operating step, which is already completed in FIG. 10, now, the base plate 28 is pulled towards the now fixedly mounted auxiliary lifting unit 10 again with the aid of the assembly unit, thus the piston/cylinder unit 32, 40 such that the feet 30 detach from the footing supports 48 and thus a free rotation of the complex of main lifting unit 52 and auxiliary lifting unit 10 is ensured.

If it is required to attach the counterweight to the crane upper structure, the piston-cylinder unit 58 can be employed as is apparent from FIG. 11, which engages with the counterweight package with its fastening 60 and lifts it upwards altogether. Therein, the auxiliary lifting unit 10 again comes to lie in its footing support and the entire counterweight package can be transported with the lifting units on the upper structure.

Figure 12:
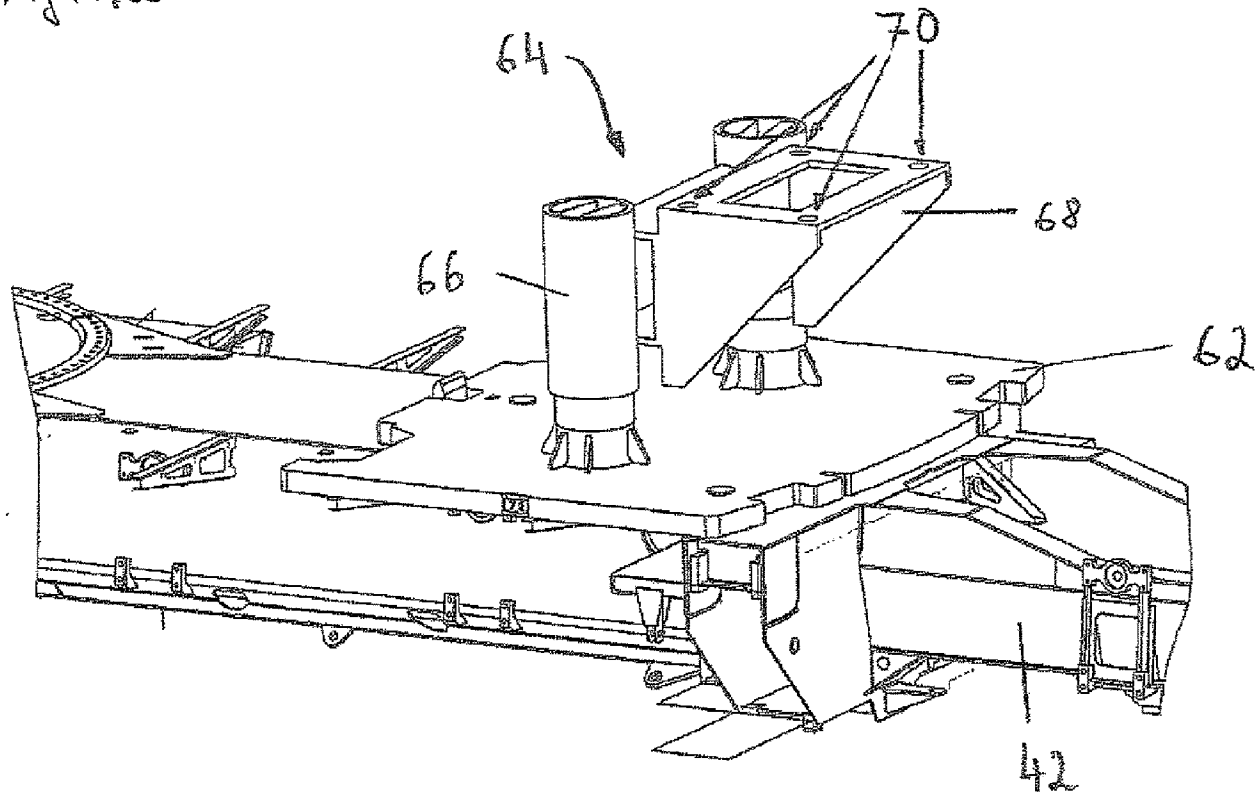
FIG. 12 is perspective view of a mounting rack adapted to receive the auxiliary lifting unit of FIG. 1 in another embodiment of an assembly system.
Figure 13:
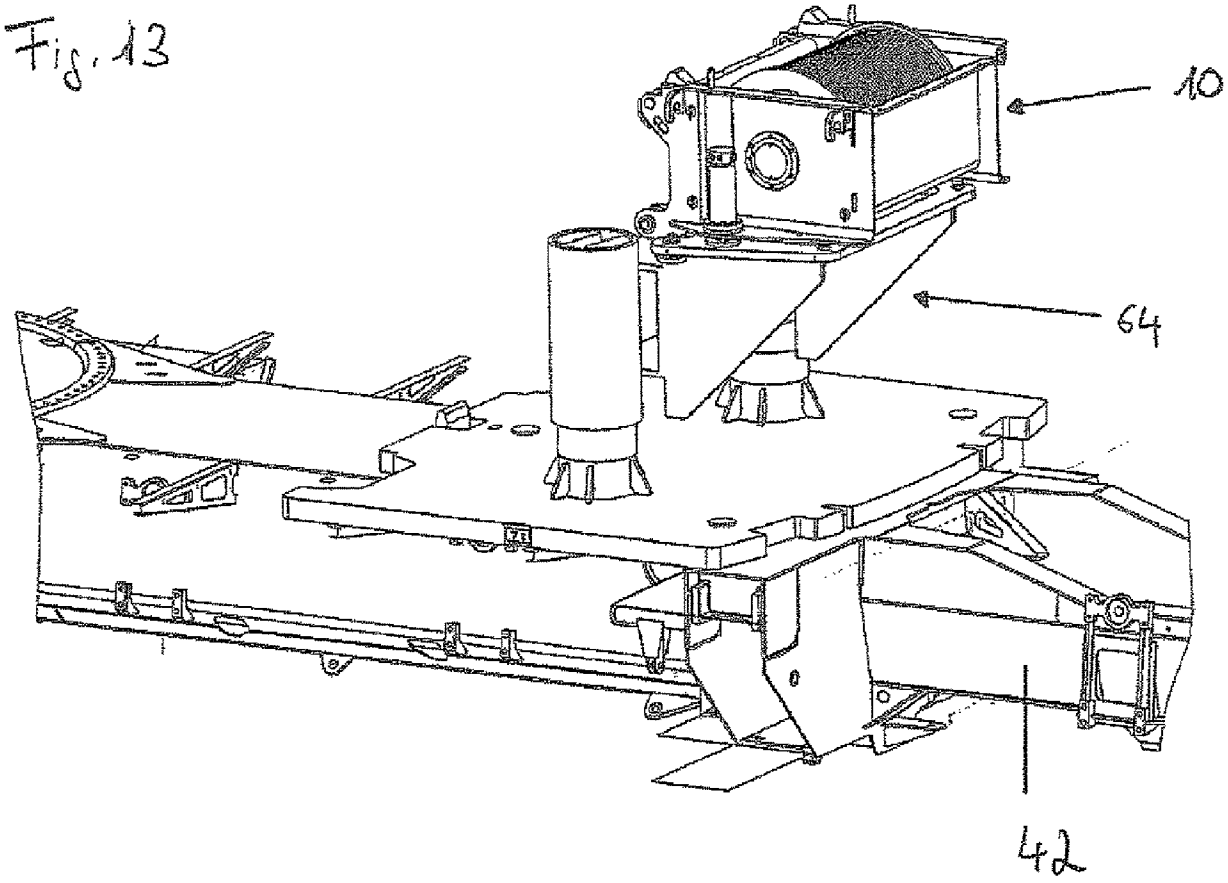
FIG. 13 is a perspective view of the mounting rack of FIG. 12 with the auxiliary lifting unit in place.
Figure 14:
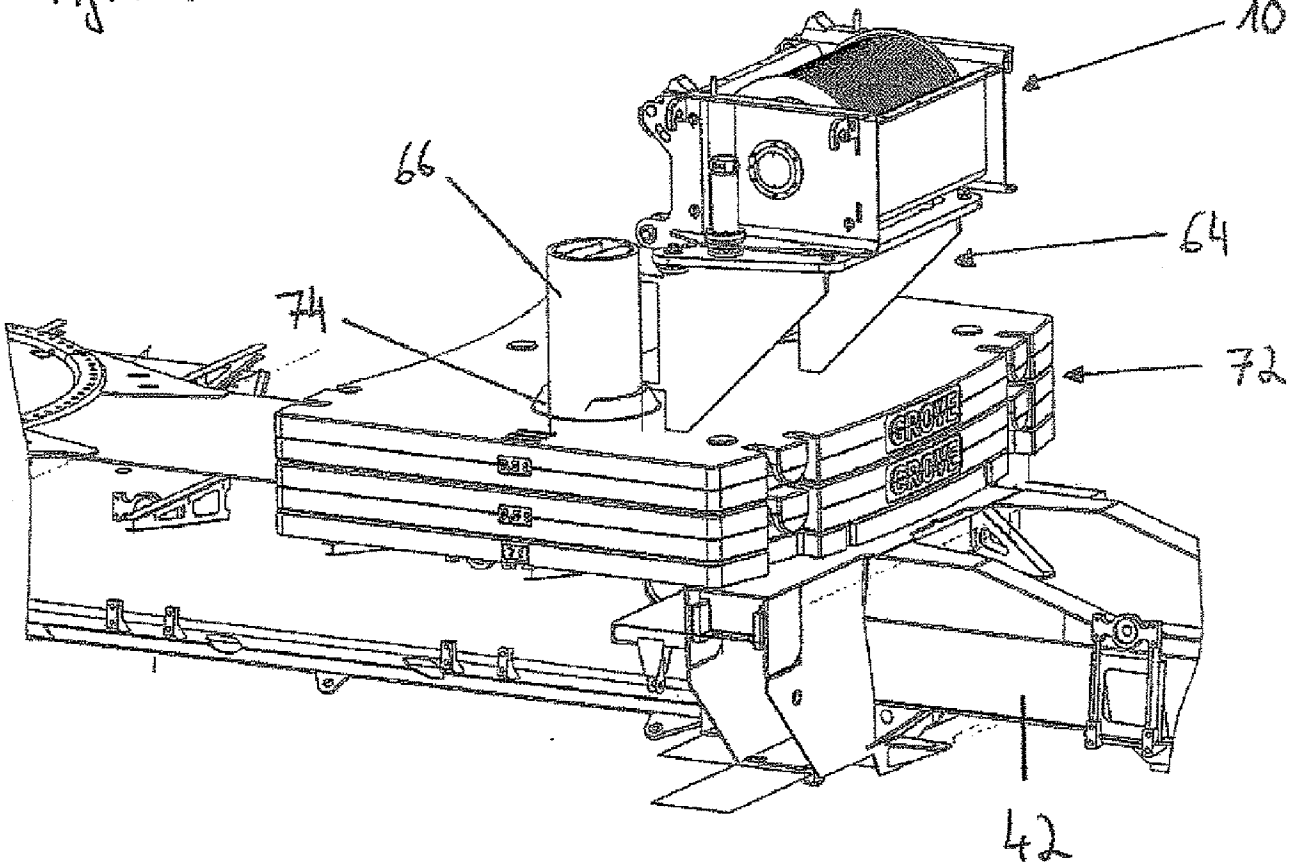
FIG. 14 is a perspective view of the mounting rack of FIG. 12 with the auxiliary lifting unit in place along with a plurality of counterweights.

A further embodiment of the present invention is illustrated in FIGS. 12 to 14. With a brief review to FIGS. 8 and 9, it can be ascertained that the auxiliary lifting unit 10 should be placed on the crane undercarriage 42 in a certain height in the inventive example demonstrated here, in order that the main lifting unit 52 can be approached and the auxiliary lifting unit can be moved into its coupled assembly position by lifting with the assembly unit. In the example of FIGS. 5 to 11, the placing height was appropriately the height of the topmost counterweight element, but there may be cases in which less or no counterweights are assembled. For these cases, according to an example for the present invention, a mounting rack can be provided as it is shown in FIG. 12 and been provided with the reference number 64. The mounting rack 64 rests with its two columns 66 on the counterweight support 62 and it supports the frame 68, in which the four foot receptacles 70 are positioned at the top, which resemble the foot receptacles 48 in arrangement and configuration, which e.g. are seen in FIG. 5.

FIG. 13 now shows how an auxiliary lifting unit 10 can be correspondingly placed on the mounting rack 46, and thus the preparation for the assembly operation is already effected, which is then effected in corresponding configuration exactly as is shown in FIGS. 8 to 10, wherein the mounting rack 64 takes over the function of the topmost counterweight plate 46 as the rest surface for the auxiliary lifting unit 10. In FIG. 14, it is finally additionally shown that the embodiment with the mounting rack works not only completely without counterweights, but also if a number of counterweights 72 are assembled, wherein these counterweights have recesses 74 for the passage of the column 66.

Figure 16:
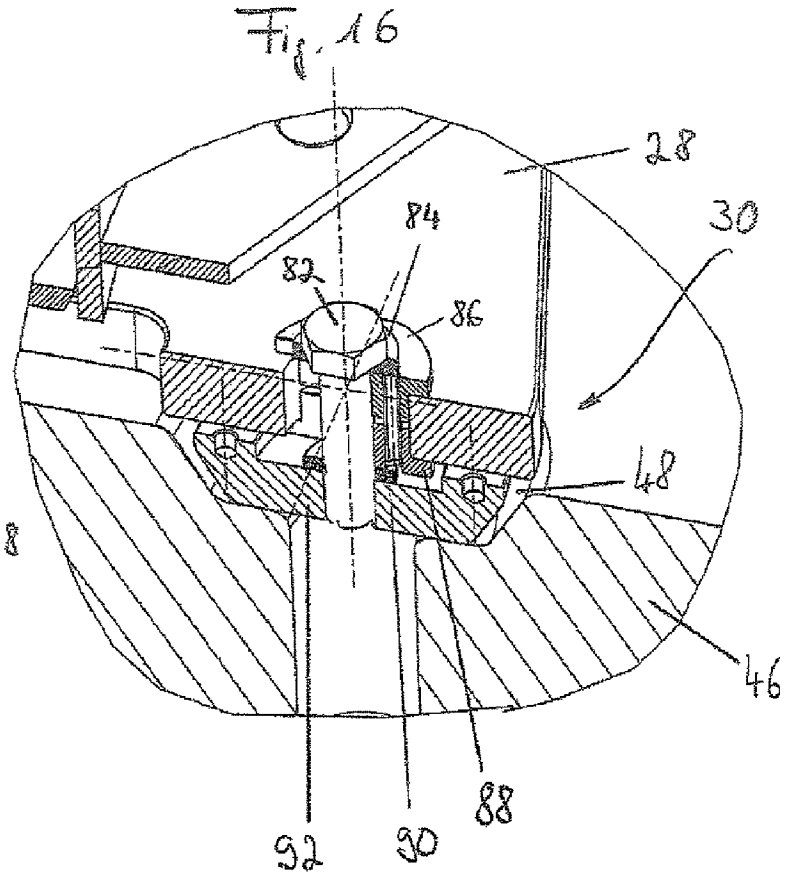
FIG. 16 is a half cut sectional view the installed footing support of FIG. 15.
Figure 15:
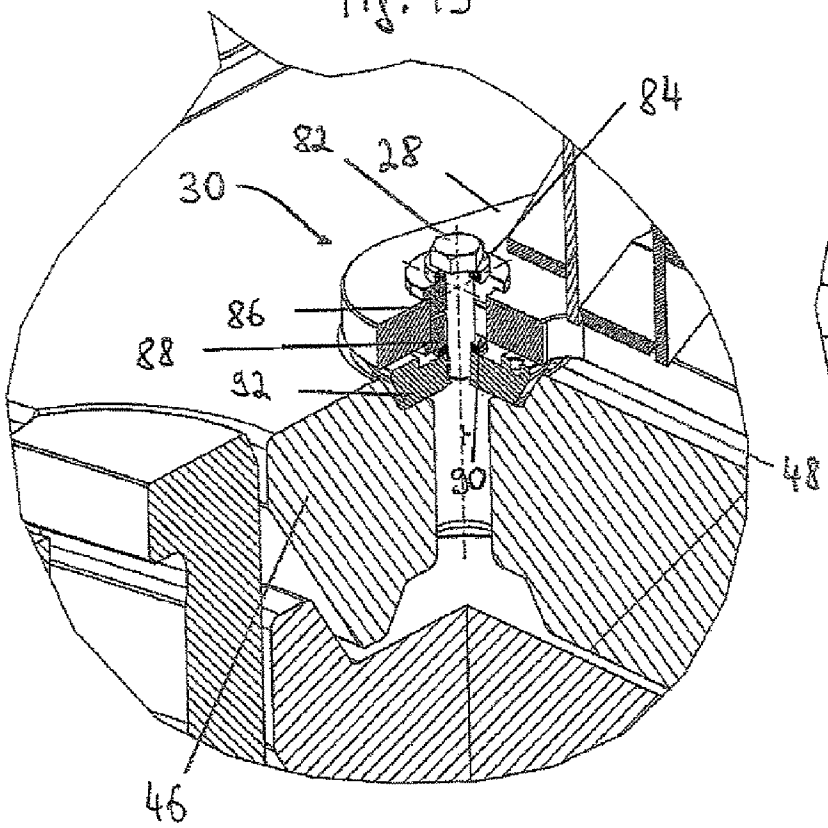
FIG. 15 is quarter cut sectional view of an installed footing support for supporting an auxiliary lifting unit.

FIGS. 15 and 16 show how the feet of the footing support provided according to the invention are designed in detail. FIG. 15 here shows a quarter cut-out view of a footing support according to the invention, while a half cut-out view is seen from FIG. 16.

The foot 30 is attached to a corner of the base plate 28, wherein its footing support element 92 comes to lie in the recess or foot receptacle 48 of a counterweight plate 46. The footing support element 92 is made of a resiliently deformable material, and already hereby, relatively large manufacturing tolerances can be compensated for, and automatic centering occurs upon insertion when the convex, conical footing support element 92 enters the concave, correspondingly inversely formed foot receptacle 48. Due to the relatively large diameter of the footing support element 92 and the foot receptacles 48, the assembly operation or the setup of the auxiliary lifting unit can be quickly effected, also because the receiving points are well visible to the crane operator. The footing support element 92, which can be configured as a special rubber spring element, provides for an automatic compensation for positioning inaccuracies as well as for radial clearance compensation in the horizontal direction.

The above mentioned horizontal adjustability or mobility resulting from the resilience of the footing support element 92 mainly acts perpendicularly to the longitudinal axis of the foot fastening, which is determined by the bolt 82. The bolt 82 is a threaded bolt, which is supported centered in a sleeve with its head at the top above a disk 84, which is has an upper half 86 and a lower half 88 and encompasses the base plate 28 on both sides. Below the lower sleeve half 88, the bolt 82 passes through a further disk 90 into the footing support element 92, whereby it is maintained in threaded engagement. The disk 90 is fixedly connected to the resilient material of the footing support element 92—it is made of a metallic material and carries an internal thread engaging with the external thread of the bolt 82 in the lower region.

In this construction, turning the bolt 82 effects the increase or decrease of the distance between the footing support element 92 and the base plate 28 such that the foot 30 can be lowered or lifted viewed from the base plate 28. From this, there results further mobility or adjustability of the footing support element 92 or of the foot 30 in longitudinal direction of its fastening, thus in longitudinal direction of the bolt and perpendicular to the horizontal fastening plane.

Figure 17:
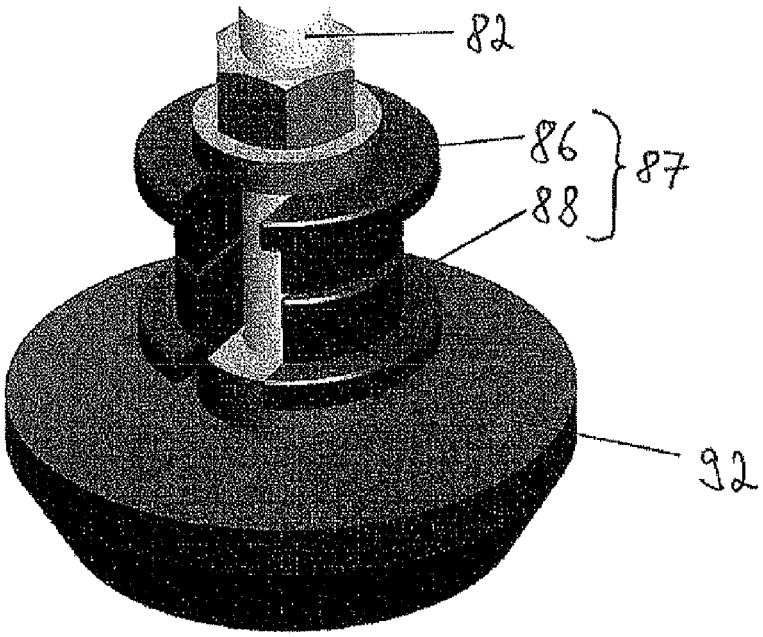
FIG. 17 is perspective view of the footing support used in FIGS. 15 and 16.

With the horizontal mechanical adjustability in two directions (x, y) and the mobility by the resilient footing support element and the height adjustability z by the bolt 82, the foot 30 is accordingly movable or adjustable in three directions in this embodiment, and thus can compensate for large manufacturing tolerances and always provide for an appropriate setup angle of the auxiliary lifting unit. This adjustability is effected by standard parts such as screws, disks and nuts and is therefore realizable in simple manner; it can also provide great adjusting ranges, for example +/−15 mm, both in the horizontal plane and in the longitudinal direction perpendicular to this. In particular, as is shown in FIG. 17, a slotted sleeve (or boss) 87 can be used for this, wherein adjustability of the direction is ensured by turning the sleeve halves 86, 87. If the halves 86, 87 are turned in one direction with commonly oriented opening, the bolt 82 can be displaced in this direction and then again be fastened. If the halves 86, 87 are twisted against each other, displacement is already excluded by form fit (optimum displacement security).

What is claimed is:

1. An assembly system for an auxiliary lifting unit of a mobile crane, the assembly system comprising:

an auxiliary lifting unit frame;

auxiliary lifting unit assembly fastenings coupled to the auxiliary lifting unit frame, the auxiliary lifting unit assembly fastenings adapted to fasten the auxiliary lifting unit frame to an upper structure of the mobile crane; and an assembly unit being different from a counterweight lifting unit designed to move counterweights of the mobile crane, wherein the assembly unit is coupled to the auxiliary lifting unit assembly fastenings and to a support base that is configured to be placed on a counterweight element, wherein the assembly unit comprises at least one piston-cylinder unit configured to move the auxiliary lifting unit frame away from the support base towards the upper structure of the mobile crane without moving the counterweight lifting unit so as to allow the auxiliary lifting unit frame to be fastened to the upper structure, and wherein the at least one piston cylinder unit is configured to pull the support base off the counterweight element towards the auxiliary lifting unit frame being fastened to the upper structure so as to free the support base from the counterweight element.

2. The assembly system according to claim 1, wherein the auxiliary lifting unit assembly fastenings are coupled to the auxiliary lifting unit frame and the assembly unit is adapted to lift auxiliary lifting unit frame and auxiliary lifting unit fastenings together.

3. The assembly system according to claim 1, wherein the auxiliary lifting unit assembly fastenings are coupled to the assembly unit and the assembly unit is adapted to lift auxiliary lifting unit fastenings relative to the auxiliary lifting unit frame.

4. The assembly system according to claim 1, wherein the assembly position is a fastening position on the upper structure of the crane, in which engagement between the auxiliary lifting unit assembly fastenings and mating fastenings on the crane upper structure occurs.

5. The assembly system according to claim 1, wherein the assembly unit is adapted to move the auxiliary lifting unit assembly fastenings into the assembly position in a direction selected from the group consisting of upwards, downwards, obliquely upwards, obliquely downwards, and laterally.

6. The assembly system according to claim 1, wherein the assembly unit includes a drive unit selected from the group consisting of an electrical drive unit, hydraulic drive unit, pneumatic drive unit, and a combination drive unit.

7. The assembly system according to claim 1, wherein the assembly unit includes a hydraulic lifting cylinder device coupled to the auxiliary lifting unit frame and is adapted to move the auxiliary lifting unit frame away from the support base.

8. The assembly system according to claim 7, wherein the support base is connected to the auxiliary lifting unit frame by the assembly unit from which the auxiliary lifting unit frame can be lifted away into the assembly position by means of the assembly unit.

9. The assembly system according to claim 8, wherein the assembly unit is connected to the support base in a compression-proof and tension-proof manner.

10. The assembly system according to claim 8, wherein a plurality of feet are disposed on the support base facing away from the auxiliary lifting unit frame.

11. The assembly system according to claim 10, wherein the plurality of feet are footing supports adjustable in position.

12. The assembly system according to claim 1, further comprising a sub-structure adapted for supporting the auxiliary lifting unit.

13. The assembly system according to claim 12, wherein the sub-structure includes a topmost mounted counterweight element.

14. The assembly system according to 12, wherein the sub-structure includes a mounting rack placed on a counterweight support.

15. The assembly installation according to claim 12, further comprising mating footing supports complementary to a plurality of feet disposed on the support base, the mating footing supports being disposed on the sub-structure.

16. A method for assembling a mobile crane auxiliary lifting unit with auxiliary lifting unit assembly fastenings, which are assigned to a frame of the auxiliary lifting unit and serve for fastening the auxiliary lifting unit to an upper structure of the crane, the method comprising:

moving the auxiliary lifting unit frame into an assembly position, wherein the movement is effected by an assembly unit different from a counterweight lifting unit of the mobile crane configured to lift counterweights of the mobile crane, the assembly unit being attached to the auxiliary lifting unit frame and to a support base that is configured to be placed on a counterweight element, wherein the assembly unit comprises at least one piston cylinder unit configured to move the auxiliary lifting unit frame, from the counterweight element towards the upper structure of the mobile crane and away from the counterweight element without moving the counterweight lifting unit so as to allow the auxiliary lifting unit frame to be fastened to the upper structure, and retract the at least one piston cylinder unit to pull the support base towards the auxiliary lifting unit frame being fastened to the upper structure so as to free the support base from the counterweight element.

17. The method according to claim 16, wherein the method is performed by an assembly system comprising:

the auxiliary lifting unit frame;

the auxiliary lifting unit assembly fastenings coupled to the auxiliary lifting unit frame, the auxiliary lifting unit assembly fastenings adapted to fasten the auxiliary lifting unit to the mobile crane; and an assembly unit coupled to the auxiliary lifting unit assembly fastenings and adapted to move the auxiliary lifting unit assembly fastenings into an assembly position.

18. A method for assembling a mobile crane auxiliary lifting unit having an assembly system with a frame, auxiliary lifting unit fastenings coupled to the frame, an assembly unit different from a counterweight lifting unit, comprising at least one piston cylinder unit configured to lift at a counterweight element of the mobile crane, and coupled to the frame, and a sub-structure coupled to the assembly unit and configured to be placed on the counterweight element, the method comprising:

causing the assembly unit to move the mobile crane auxiliary lifting unit frame relative to the sub-structure from a first location to a second location;

positioning a crane upper structure adjacent the auxiliary lifting unit assembly fastenings;

causing the assembly unit to move the auxiliary lifting unit frame from the counterweight element towards the upper structure of the mobile crane with the counterweight lifting unit being unactuated so as to allow the auxiliary lifting unit frame to be fastened to the upper structure; and causing the at least one piston cylinder unit to pull the sub-structure towards the auxiliary lifting unit frame so as to free the sub-structure from the counterweight element.

* * * * *